US011268170B2

(12) United States Patent
Rame et al.

(10) Patent No.: US 11,268,170 B2
(45) Date of Patent: Mar. 8, 2022

(54) NICKEL-BASED SUPERALLOY, SINGLE-CRYSTAL BLADE AND TURBOMACHINE

(71) Applicants: SAFRAN, Paris (FR); OFFICE NATIONAL D'ETUDES ET DE RECHERCHES AEROSPATIALES, Palaiseau (FR)

(72) Inventors: Jérémy Rame, Moissy-Cramayel (FR); Virginie Jaquet, Moissy-Cramayel (FR); Joël Delautre, Moissy-Cramayel (FR); Jean-Yves Guedou, Moissy-Cramayel (FR); Pierre Caron, Les Ulis (FR); Odile Lavigne, Paris (FR); Didier Locq, Le Plessis Robinson (FR); Mikael Perrut, Issy-les-Moulineaux (FR)

(73) Assignees: SAFRAN, Paris (FR); OFFICE NATIONAL D'ETUDES ET DE RECHERCHES AEROSPATIALES, Palaiseau (FR)

( * ) Notice: Subject to any disclaimer, the term of this patent is extended or adjusted under 35 U.S.C. 154(b) by 0 days.

(21) Appl. No.: 16/763,713

(22) PCT Filed: Nov. 14, 2018

(86) PCT No.: PCT/FR2018/052840
§ 371 (c)(1),
(2) Date: May 13, 2020

(87) PCT Pub. No.: WO2019/097163
PCT Pub. Date: May 23, 2019

(65) Prior Publication Data

US 2020/0299808 A1 Sep. 24, 2020

(30) Foreign Application Priority Data

Nov. 14, 2017 (FR) ..... 1760675

(51) Int. Cl.
*C22C 19/05* (2006.01)
*F01D 5/28* (2006.01)

(52) U.S. Cl.
CPC ..... *C22C 19/057* (2013.01); *F01D 5/288* (2013.01)

(58) Field of Classification Search
None
See application file for complete search history.

(56) References Cited

U.S. PATENT DOCUMENTS 5,270,123 A 12/1993 Walston et al.
5,366,695 A 11/1994 Erickson
(Continued)

FOREIGN PATENT DOCUMENTS

CN 1123874 A 6/1996
CN 101733610 A 6/2010
(Continued)

OTHER PUBLICATIONS

Gregori, A. et al., "Welding and Deposition of Nickel Superalloys 718, Waspaloy and Single Crystal Alloy CMSX-10," *Welding in the World*, vol. 51, pp. 34-47 (2007).
(Continued)

*Primary Examiner* — Seth Dumbris
*Assistant Examiner* — Kim S. Horger
(74) *Attorney, Agent, or Firm* — Bookoff McAndrews, PLLC

(57) ABSTRACT

A nickel-based superalloy comprises, in percentages by mass, 4.0 to 5.5% rhenium, 3.5 to 12.5% cobalt, 0.30 to 1.50% molybdenum, 3.5 to 5.5% chromium, 3.5 to 5.5% tungsten, 4.5 to 6.0% aluminum, 0.35 to 1.50% titanium, 8.0 to 10.5% tantalum, 0.15 to 0.30% hafnium, 0.05 to 0.15% silicon, the balance being nickel and unavoidable impurities.
(Continued)

A single-crystal blade comprises such an alloy and a turbomachine comprising such a blade.

24 Claims, 2 Drawing Sheets

(56) References Cited

U.S. PATENT DOCUMENTS

| | | | | |
|---|---|---|---|---|
| 5,888,451 | A | 3/1999 | Konter et al. | |
| 6,419,763 | B1 | 7/2002 | Konter et al. | |
| 7,473,326 | B2 | 1/2009 | Kobayashi et al. | |
| 2010/0143182 | A1* | 6/2010 | Sato | C22C 19/057 420/444 |
| 2015/0322550 | A1 | 11/2015 | Harris et al. | |
| 2017/0241005 | A1* | 8/2017 | Goehler | C23C 4/08 |

FOREIGN PATENT DOCUMENTS

| | | | | |
|---|---|---|---|---|
| CN | 102732750 | A | 10/2012 | |
| EP | 0577316 | A2 | 1/1994 | |
| EP | 0971041 | A1 | 1/2000 | |
| EP | 2631324 | A1 | 8/2013 | |
| JP | H11-310839 | A | 11/1999 | |
| JP | 2008-045176 | A | 2/2008 | |
| RU | 2293782 | C1 | 2/2007 | |
| RU | 2415190 | C2 | 3/2011 | |
| WO | WO 2017/021685 | A1 | 2/2017 | |
| WO | WO-2017021685 | A1 * | 2/2017 | C22C 19/05 |

OTHER PUBLICATIONS

Official Communication dated Jun. 27, 2018, in FR Application No. 1760675 (7 pages).

International Search Report issued in International Application No. PCT/FR2018/052840 dated Mar. 22, 2019, with English translation (5 pages).

Official Communication dated Jun. 21, 2018, in FR Application No. 1760679 (2 pages).

International Search Report issued in International Application No. PCT/FR2018/052839 dated Feb. 5, 2019, with English translation (5 pages).

Morinaga, M. et al., "New Phacomp and its Applications to Alloy Design," pp. 523-532 (1984).

Chinese Office Action issued in Patent Application No. 201880073598.3 dated Jun. 21, 2021 and English Translation. (20 pages).

Jingui Li, et al., Jul. 31, 1988; Corrosion and Corrosion Control Handbook; pp. 147-148; National Defense Industry Press. (2 pages).

Office action issued in Russian Application No. 2020119484 dated Nov. 22, 2021 with English Translation (15 pages).

* cited by examiner

NICKEL-BASED SUPERALLOY, SINGLE-CRYSTAL BLADE AND TURBOMACHINE

CROSS-REFERENCE TO RELATED APPLICATIONS

This application is the U.S. national phase entry under 35 U.S.C. § 371 of International Application No. PCT/FR2018/052840, filed on Nov. 14, 2018, which claims priority to French Patent Application No. 1760675, filed on Nov. 14, 2017.

BACKGROUND OF THE INVENTION

The present disclosure relates to nickel-based superalloys for gas turbines, in particular for stationary blades, also known as nozzles or rectifiers, or moving blades of a gas turbine, for example in the aerospace industry.

Nickel-based superalloys are known to be used in the manufacture of fixed or moving single-crystal gas turbine blades for aircraft and helicopter engines.

The main advantages of these materials are the combination of high creep strength at high temperatures and resistance to oxidation and corrosion.

Over time, nickel-based superalloys for single-crystal blades have undergone major changes in their chemical composition, with the aim in particular of improving their creep properties at high temperatures while maintaining resistance to the very aggressive environment in which these superalloys are used.

In addition, metallic coatings adapted to these alloys have been developed to increase their resistance to the aggressive environment in which these alloys are used, including oxidation resistance and corrosion resistance. In addition, a ceramic coating of low thermal conductivity, fulfilling a thermal barrier function, can be added to reduce the temperature at the surface of the metal.

Typically, a complete protection system consists of at least two layers.

The first layer, also called the sublayer or bond coat, is deposited directly on the nickel-based superalloy component to be protected, also known as the substrate, for example a blade. The deposition step is followed by a diffusion step of the bond coat into the superalloy. Deposition and diffusion can also be carried out in a single step.

The materials generally used to make this bond coat include alumina forming metal alloys of the MCrAlY type (M=Ni (nickel) or Co (cobalt)) or a mixture of Ni and Co, Cr=chromium, Al=aluminum and Y=yttrium, or nickel aluminide ($Ni_xAl_y$) type alloys, some also containing platinum ($Ni_xAl_yPt_z$).

The second layer, generally called a thermal barrier coating (TBC), is a ceramic coating comprising, for example, yttriated zirconia, also called yttria stabilized zirconia (YSZ) or yttria partially stabilized zirconia (YPSZ), and having a porous structure. This layer can be deposited by various processes, such as electron beam physical vapor deposition (EB-PVD), atmospheric plasma spraying (APS), suspension plasma spraying (SPS), or other processes to produce a porous ceramic coating with low thermal conductivity.

Due to the use of these materials at high temperatures, for example 650° C. to 1150° C., microscopic interdiffusion phenomena occur between the nickel-based superalloy of the substrate and the metal alloy of the bond coat. These interdiffusion phenomena, associated with the oxidation of the bond coat, modify in particular the chemical composition, the microstructure and consequently the mechanical properties of the bond coat as soon as the coating is manufactured, then during the use of the blade in the turbine. These interdiffusion phenomena also modify the chemical composition, the microstructure and consequently the mechanical properties of the superalloy of the substrate under the coating. In superalloys with a high content of refractory elements, particularly rhenium, a secondary reaction zone (SRZ) can thus be formed in the superalloy under the coating over a depth of several tens, or even hundreds, of micrometers. The mechanical characteristics of this SRZ are significantly lower than those of the superalloy substrate. The formation of SRZs is undesirable because it leads to a significant reduction in the mechanical strength of the superalloy.

These changes in the bond coat, together with the stress fields associated with the growth of the alumina layer that forms in service on the surface of this bond coat, also known as thermally grown oxide (TGO), and the differences in the coefficients of thermal expansion between the different layers, generate de-cohesions in the interfacial zone between the sublayer and the ceramic coating, which can lead to partial or total flaking of the ceramic coating. The metal part (superalloy substrate and metallic bond coat) is then exposed and directly exposed to the combustion gases, which increases the risk of damage to the blade and thus to the gas turbine.

In addition, the complex chemistry of these alloys can lead to a destabilization of their optimal microstructure with the appearance of undesirable phase particles during high-temperature maintenance of parts formed from these alloys. This destabilization has negative consequences on the mechanical properties of these alloys. These undesirable phases of complex crystal structure and brittle nature are called topologically close-packed (TCP) phases.

In addition, casting defects may form in components, such as blades, when they are manufactured by directional solidification. These defects are usually "freckle" type grain defects, the presence of which can cause premature failure of the part in service. The presence of these defects, linked to the chemical composition of the superalloy, generally leads to rejection of the component, which increases the production cost.

SUBJECT MATTER AND SUMMARY OF THE INVENTION

The present disclosure aims to propose nickel-based superalloy compositions for the manufacture of single-crystal components, with improved performance in terms of service life and mechanical strength, and allowing a reduction in part production costs (reduced scrap rate) compared with existing alloys. These superalloys have a higher creep resistance at high temperature than existing alloys while showing good microstructural stability in the volume of the superalloy (low sensitivity to TCP formation), good microstructural stability under the thermal barrier coating bond coat (low sensitivity to SRZ formation), good resistance to oxidation and corrosion while avoiding the formation of "freckle" type parasitic grains.

For this purpose, the present disclosure relates to a nickel-based superalloy comprising, in percentages by mass, 4.0 to 5.5% rhenium, 3.5 to 12.5% cobalt, 0.30 to 1.50% molybdenum, 3.5 to 5.5% chromium, 3.5 to 5.5% tungsten, 4.5 to 6.0% aluminum, 0.35 to 1.50% titanium, 8.0 to 10.5% tantalum, 0.15 to 0.30% hafnium, preferably 0.16 to 0.30% hafnium, preferably 0.17 to 0.30% hafnium, more preferably 0.18 to 0.30% hafnium, even more preferably 0.20 to 0.30% hafnium, 0.05 to 0.15% silicon, preferably 0.08 to 0.12% silicon, even more preferably 0.10% silicon, the balance being nickel and unavoidable impurities.

This superalloy is intended for the manufacture of single-crystal gas turbine components, such as fixed or moving blades.

Thanks to this composition of the nickel (Ni)-based superalloy, the creep resistance is improved compared with existing superalloys, particularly at temperatures up to 1200° C.

This alloy therefore has improved high temperature creep resistance. This alloy also has improved corrosion and oxidation resistance.

These superalloys have a density less than or equal to 9.00 g/cm$^3$ (grams per cubic centimeter).

A single-crystalline nickel-based superalloy component is obtained by a process of directed solidification under a thermal gradient in an investment casting. The nickel-based single-crystal superalloy comprises an austenitic matrix with a face-centered cubic structure, a nickel-based solid solution known as the gamma (γ) phase. This matrix contains gamma prime (γ') hardening phase precipitates of $L1_2$ ordered cubic structure of $Ni_3Al$ type. The set (matrix and precipitates) is thus described as a γ/γ' superalloy.

In addition, this composition of the nickel-based superalloy allows the implementation of a heat treatment that brings back into solution the γ' phase precipitates and the γ/γ' eutectic phases that are formed during the solidification of the superalloy. Thus, a nickel-based single-crystal superalloy can be obtained containing γ' precipitates of controlled size, preferably between 300 and 500 nanometers (nm), and containing a small proportion of the γ/γ' eutectic phases.

The heat treatment also makes it possible to control the volume fraction of the γ' phase precipitates present in the nickel-based single-crystal superalloy. The volume percentage of γ' phase precipitates may be greater than or equal to 50%, preferably greater than or equal to 60%, even more preferably equal to 70%.

The major addition elements are cobalt (Co), chromium (Cr), molybdenum (Mo), rhenium (Re), tungsten (W), aluminum (Al), titanium (Ti) and tantalum (Ta).

The minor addition elements are hafnium (Hf) and silicon (Si), for which the maximum content is less than 1% by mass.

Unavoidable impurities include sulfur (S), carbon (C), boron (B), yttrium (Y), lanthanum (La) and cerium (Ce). Unavoidable impurities are defined as those elements that are not intentionally added in the composition and are brought in with other elements.

The addition of tungsten, chromium, cobalt, rhenium or molybdenum is mainly used to reinforce the austenitic matrix γ with a face-centered cubic (fcc) crystal structure by solid solution hardening.

The addition of aluminum, titanium or tantalum (Ta) promotes the precipitation of the hardening phase γ'-$Ni_3$(Al, Ti, Ta).

Rhenium slows down the diffusion of chemical species within the superalloy and limits the coalescence of γ' phase precipitates during service at high temperature, a phenomenon that leads to a reduction in mechanical strength. Rhenium thus improves the creep resistance at high temperature of the nickel-based superalloy. However, too high a rhenium concentration can lead to the precipitation of TCP intermetallic phases, for example a phase, P phase or μ phase, which have a negative effect on the mechanical properties of the superalloy. An excessive rhenium concentration can also lead to the formation of a secondary reaction zone in the superalloy below the bond coat, which has a negative effect on the mechanical properties of the superalloy.

The simultaneous addition of silicon and hafnium improves the hot oxidation resistance of nickel-based superalloys by increasing the adhesion of the alumina ($Al_2O_3$) layer that forms on the surface of the superalloy at high temperature. This alumina layer forms a passivation layer on the surface of the nickel-based superalloy and a barrier to diffusion of oxygen from the outside to the inside of the nickel-based superalloy. However, hafnium can be added without also adding silicon, or conversely, silicon can be added without also adding hafnium and still improve the hot oxidation resistance of the superalloy.

In addition, the addition of chromium or aluminum improves the superalloy's resistance to oxidation and high-temperature corrosion. In particular, chromium is essential for increasing the hot corrosion resistance of nickel-based superalloys. However, too high a chromium content tends to reduce the solvus temperature of the γ' phase of the nickel-based superalloy, i.e. the temperature above which the γ' phase is completely dissolved in the γ matrix, which is undesirable. Therefore, the chromium concentration is between 3.5 and 5.5% by mass in order to maintain a high solvus temperature of the γ' phase of the nickel-based superalloy, for example greater than or equal to 1250° C., but also to avoid the formation of topologically compact phases in the γ matrix that are highly saturated with alloying elements such as rhenium, molybdenum or tungsten.

The addition of cobalt, which is an element close to nickel and partially substitutes for nickel, forms a solid solution with the nickel in the γ matrix. The cobalt strengthens the γ matrix and reduces the susceptibility to TCP precipitation and the formation of SRZ in the superalloy under the protective coating. However, too high a cobalt content tends to reduce the solvus temperature of the γ' phase of the nickel-based superalloy, which is undesirable.

The addition of refractory elements such as molybdenum, tungsten, rhenium or tantalum helps to slow down the mechanisms controlling the creep of nickel-based superalloys which depend on the diffusion of chemical elements into the superalloy.

A very low sulfur content in a nickel-based superalloy increases the resistance to oxidation and hot corrosion as well as the resistance to thermal barrier chipping. A low sulfur content of less than 2 ppm by mass (parts per million by mass), or ideally less than 0.5 ppm by mass, makes it possible to optimize these properties. Such a mass sulfur content can be obtained by producing a low sulfur mother melt or by a desulfurization process carried out after casting. In particular, it is possible to maintain a low sulfur content by adapting the superalloy production process.

Nickel-based superalloys are defined as superalloys with a majority nickel content by mass percentage. It is understood that nickel is therefore the element with the highest mass percentage in the alloy.

The superalloy may comprise, in percentages by mass, 4.0 to 5.5% rhenium, 3.5 to 8.5% cobalt, 0.30 to 1.50% molybdenum, 3.5 to 5.5% chromium, 3.5 to 4.5% tungsten, 4.5 to 6.0% aluminum, 0.50 to 1.50% titanium, 8.0 to 10.5% tantalum, 0.15 to 0.30% hafnium, preferably 0.17 to 0.30% hafnium, even more preferably 0.20 to 0.30% hafnium, 0.05 to 0.15% silicon, the balance being nickel and unavoidable impurities.

The superalloy may comprise, in percentages by mass, 4.0 to 5.5% rhenium, 3.5 to 12.5% cobalt, 0.30 to 1.50% molybdenum, 3.5 to 5.5% chromium, 3.5 to 5.5% tungsten, 5.0 to 6.0% aluminum, 0.35 to 1.50% titanium, 8.0 to 10.5% tantalum, 0.15 to 0.30% hafnium, preferably 0.17 to 0.30% hafnium, even more preferably 0.20 to 0.30% hafnium, 0.05 to 0.15% silicon, the balance being nickel and unavoidable impurities.

The superalloy may comprise, in percentages by mass, 4.5 to 5.5% rhenium, 4.0 to 6.0% cobalt, 0.30 to 1.00% molybdenum, 3.5 to 4.5% chromium, 3.5 to 4.5% tungsten, 4.5 to 6.0% aluminum, 0.50 to 1.50% titanium, 8.0 to 10.5% tantalum, 0.15 to 0.30% hafnium, preferably 0.17 to 0.30% hafnium, even more preferably 0.20 to 0.30% hafnium, 0.05 to 0.15% silicon, the balance being nickel and unavoidable impurities.

The superalloy may comprise, in percentages by mass, 4.5 to 5.5% rhenium, 3.5 to 12.5% cobalt, 0.50 to 1.50% molybdenum, 3.5 to 4.5% chromium, 3.5 to 4.5% tungsten, 5.0 to 6.0% aluminum, 0.50 to 1.50% titanium, 8.0 to 9.0% tantalum, 0.15 to 0.30% hafnium, preferably 0.17 to 0.30% hafnium, even more preferably 0.20 to 0.30% hafnium, 0.05 to 0.15% silicon, the balance being nickel and unavoidable impurities.

The superalloy may comprise, in percentages by mass, 4.5 to 5.5% rhenium, 7.0 to 9.0% cobalt, 0.50 to 1.50% molybdenum, 3.5 to 4.5% chromium, 3.5 to 4.5% tungsten, 5.0 to 6.0% aluminum, 0.50 to 1.50% titanium, 8.0 to 9.0% tantalum, 0.15 to 0.30% hafnium, preferably 0.17 to 0.30% hafnium, even more preferably 0.20 to 0.30% hafnium, 0.05 to 0.15% silicon, the balance being nickel and unavoidable impurities.

The superalloy may comprise, in percentages by mass, 4.2 to 5.3% rhenium, 6.0 to 8.0% cobalt, 0.30 to 1.00% molybdenum, 3.5 to 4.5% chromium, 4.5 to 5.5% tungsten, 5.0 to 6.0% aluminum, 0.35 to 1.30% titanium, 8.0 to 9.0% tantalum, 0.15 to 0.30% hafnium, preferably 0.17 to 0.30% hafnium, even more preferably 0.20 to 0.30% hafnium, 0.05 to 0.15% silicon, the balance being nickel and incidental impurities.

The superalloy may comprise, in percentages by mass, 4.0 to 5.0% rhenium, 4.0 to 6.0% cobalt, 0.30 to 1.00% molybdenum, 4.5 to 5.5% chromium, 3.5 to 4.5% tungsten, 5.0 to 6.0% aluminum, 0.35 to 1.30% titanium, 8.0 to 10.5% tantalum, 0.15 to 0.30% hafnium, preferably 0.17 to 0.30% hafnium, even more preferably 0.20 to 0.30% hafnium, 0.05 to 0.15% silicon, the balance being nickel and unavoidable impurities.

The superalloy may comprise, in percentages by mass, 5.2% rhenium, 5.0% cobalt, 0.50% molybdenum, 4.0% chromium, 4.0% tungsten, 5.4% aluminum, 1.00% titanium, 8.5% tantalum, 0.25% hafnium, 0.10% silicon, with the balance nickel and unavoidable impurities.

The superalloy may comprise, in percentages by mass, 5.2% rhenium, 5.0% cobalt, 0.50% molybdenum, 4.0% chromium, 4.0% tungsten, 5.4% aluminum, 1.00% titanium, 8.5% tantalum, 0.17% hafnium, 0.10% silicon, with the balance nickel and unavoidable impurities.

The superalloy may comprise, in percentages by mass, 5.2% rhenium, 5.0% cobalt, 0.50% molybdenum, 4.0% chromium, 4.0% tungsten, 5.1% aluminum, 1.00% titanium, 10.0% tantalum, 0.25% hafnium, 0.10% silicon, with the balance nickel and unavoidable impurities.

The superalloy may comprise, in percentages by mass, 5.0% rhenium, 12.0% cobalt, 1.00% molybdenum, 4.0% chromium, 4.0% tungsten, 5.4% aluminum, 1.00% titanium, 8.5% tantalum, 0.25% hafnium, 0.10% silicon, with the balance nickel and unavoidable impurities.

The superalloy may comprise, in percentages by mass, 5.0% rhenium, 4.0% cobalt, 1.00% molybdenum, 4.0% chromium, 4.0% tungsten, 5.4% aluminum, 1.00% titanium, 8.5% tantalum, 0.25% hafnium, 0.10% silicon, with the balance nickel and unavoidable impurities.

The superalloy may comprise, in percentages by mass, 4.9% rhenium, 8.0% cobalt, 1.00% molybdenum, 4.2% chromium, 4.0% tungsten, 5.4% aluminum, 1.00% titanium, 8.5% tantalum, 0.25% hafnium, 0.10% silicon, with the balance nickel and unavoidable impurities.

The superalloy may comprise, in percentages by mass, 4.9% rhenium, 8.0% cobalt, 1.00% molybdenum, 4.2% chromium, 4.0% tungsten, 5.4% aluminum, 1.00% titanium, 8.5% tantalum, 0.17% hafnium, 0.10% silicon, with the balance nickel and unavoidable impurities.

The superalloy may comprise, in percentages by mass, 4.9% rhenium, 8.0% cobalt, 1.00% molybdenum, 4.2% chromium, 4.0% tungsten, 5.4% aluminum, 1.00% titanium, 8.5% tantalum, 0.16% hafnium, 0.10% silicon, with the balance nickel and unavoidable impurities.

The superalloy may comprise, in percentages by mass, 4.7% rhenium, 7.0% cobalt, 0.50% molybdenum, 4.0% chromium, 5.0% tungsten, 5.4% aluminum, 0.80% titanium, 8.5% tantalum, 0.25% hafnium, 0.10% silicon, with the balance nickel and unavoidable impurities.

The superalloy may comprise, in percentages by mass, 4.5% rhenium, 5.0% cobalt, 0.50% molybdenum, 5.0% chromium, 4.0% tungsten, 5.4% aluminum, 1.00% titanium, 8.5% tantalum, 0.25% hafnium, 0.10% silicon, the balance being nickel and unavoidable impurities.

The superalloy may comprise, in percentages by mass, 4.5% rhenium, 5.0% cobalt, 0.50% molybdenum, 5.0% chromium, 4.0% tungsten, 5.4% aluminum, 0.55% titanium, 10.0% tantalum, 0.25% hafnium, 0.10% silicon, with the balance nickel and unavoidable impurities.

The superalloy may comprise, in percentages by mass, 4.3% rhenium, 5.0% cobalt, 0.50% molybdenum, 4.0% chromium, 4.0% tungsten, 5.4% aluminum, 1.00% titanium, 8.5% tantalum, 0.25% hafnium, 0.10% silicon, with the balance nickel and unavoidable impurities.

The present disclosure also relates to a single-crystal blade for turbomachines comprising a superalloy as defined above.

This blade therefore has improved creep resistance at high temperatures.

The blade may comprise a protective coating comprising a metallic bond coat deposited on the superalloy and a ceramic thermal barrier deposited on the metallic bond coat.

Due to the composition of the nickel-based superalloy, the formation of a secondary reaction zone in the superalloy resulting from interdiffusion phenomena between the superalloy and the sub-layer is avoided, or limited.

The metallic bond coat can be an MCrAlY type alloy or a nickel aluminide type alloy.

The ceramic thermal barrier can be an yttriated zirconia-based material or any other ceramic (zirconia-based) coating with low thermal conductivity.

The vane may have a structure oriented in a <001> crystallographic direction.

This orientation generally gives the optimum mechanical properties to the blade.

The present disclosure also relates to a turbomachine comprising a blade as defined above.

BRIEF DESCRIPTION OF THE DRAWINGS

Other features and advantages of the invention will be apparent from the following description of embodiments of the invention, given by way of non-limiting examples, with reference to the single appended figure wherein.

DETAILED DESCRIPTION OF THE INVENTION

Nickel-based superalloys are intended for the manufacture of single-crystal blades by a process of directed solidification in a thermal gradient. The use of a monocrystalline seed or grain selector at the beginning of solidification makes it possible to obtain this monocrystalline structure. The structure is oriented, for example, in a <001> crystallographic direction which is the orientation that generally confers the optimum mechanical properties on superalloys.

Solidified single-crystal nickel-based superalloys have a dendritic structure and consist of γ' $Ni_3$(Al, Ti, Ta) precipitates dispersed in a γ matrix of face-centered cubic structure, a nickel-based solid solution. These γ' phase precipitates are heterogeneously distributed in the volume of the single crystal due to chemical segregations resulting from the solidification process. In addition, γ/γ' eutectic phases are present in the inter-dendritic regions and are preferred crack initiation sites. These γ/γ' eutectic phases are formed at the end of solidification. Moreover, the γ/γ' eutectic phases are formed to the detriment of the fine precipitates (size lower than one micrometer) of the γ' hardening phase. These γ' phase precipitates constitute the main source of hardening of nickel-based superalloys. Also, the presence of residual γ/γ' eutectic phases does not allow optimization of the hot creep resistance of the nickel-based superalloy.

It has indeed been shown that the mechanical properties of superalloys, in particular the creep resistance, were optimal when the precipitation of the γ' precipitates was ordered, i.e. the γ' phase precipitates were aligned in a regular way, with a size ranging from 300 to 500 nm, and when the totality of the γ/γ' eutectic phases was put back into solution.

Raw solidified nickel-based superalloys are therefore heat-treated to obtain the desired distribution of the different phases. The first heat treatment is a homogenization treatment of the microstructure which aims to dissolve the γ' phase precipitates and to eliminate the γ/γ' eutectic phases or to significantly reduce their volume fraction. This treatment is carried out at a temperature higher than the solvus temperature of the γ' phase and lower than the starting melting temperature of the superalloy ($T_{solidus}$). A quenching is then carried out at the end of this first heat treatment to obtain a fine and homogeneous dispersion of the γ' precipitates. Tempering heat treatments are then carried out in two stages, at temperatures below the solvus temperature of the γ' phase. In a first step, to grow the γ' precipitates to the desired size, then in a second step, to grow the volume fraction of this phase to about 70% at room temperature.

Figure 1:
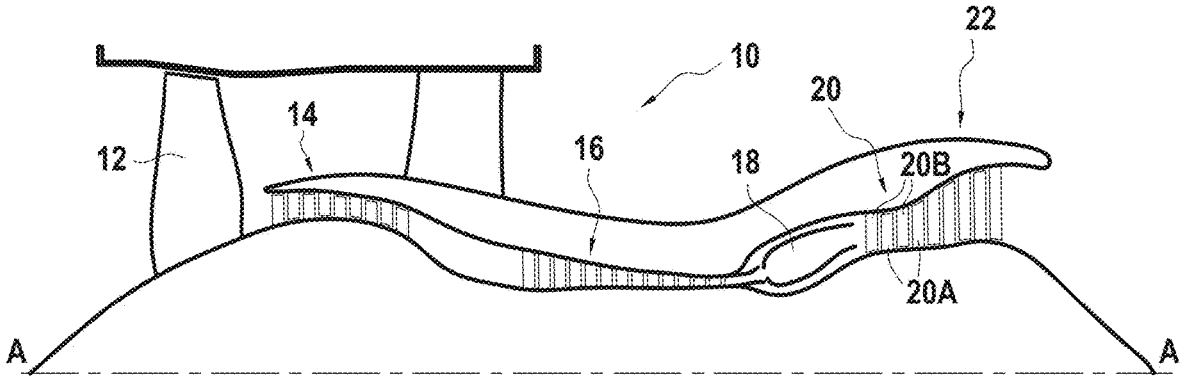
FIG. 1 is a schematic longitudinal section view of a turbomachine.

FIG. 1 shows a vertical cross-section of a bypass turbofan engine 10 in a vertical plane through its main axis A. The turbofan engine 10 comprises, from upstream to downstream according to the flow of air, a fan 12, a low-pressure compressor 14, a high-pressure compressor 16, a combustor 18, a high-pressure turbine 20, and a low-pressure turbine 22.

The high-pressure turbine 20 comprises a plurality of moving blades 20A rotating with the rotor and rectifiers 20B (stationary blades) mounted on the stator. The stator of the turbine 20 comprises a plurality of stator rings (not shown) arranged opposite to the moving blades 20A of the turbine 20.

These properties thus make these superalloys interesting candidates for the manufacture of single-crystal parts for the hot parts of turbojet engines.

A moving blade 20A or a rectifier 20B for turbomachinery comprising a superalloy as defined above can therefore be manufactured.

Alternatively, a moving blade 20A or rectifier 20B for a turbomachine comprising a superalloy as defined above coated with a protective coating comprising a metallic bond coat.

A turbomachine can in particular be a turbojet engine such as a turbofan engine 10. A turbomachine may also be a single-flow turbojet engine, a turboprop engine or a turboshaft engine.

EXAMPLES

Ten nickel-based single-crystal superalloys in this paper (Ex 1 to Ex 10) were studied and compared with four commercial single-crystal superalloys CMSX-4 (Ex 11), CMSX-4PlusC (Ex 12), CMSX-10 (Ex 13) and René N6 (Ex 14). The chemical composition of each of the single-crystal superalloys is given in Table 1, the composition Ex 13 further comprising 0.10% by mass niobium (Nb) and the composition Ex 14 further comprising 0.05% by mass carbon (C) and 0.004% by mass boron (B). All these superalloys are nickel-based superalloys, i.e. the balance to 100% of the compositions shown consists of nickel and unavoidable impurities.

TABLE 1

| | Re | Co | Mo | Cr | W | Al | Ti | Ta | Hf | Si |
|---|---|---|---|---|---|---|---|---|---|---|
| Ex 1 | 5.2 | 5.0 | 0.50 | 4.0 | 4.0 | 5.4 | 1.00 | 8.5 | 0.25 | 0.10 |
| Ex 2 | 5.2 | 5.0 | 0.50 | 4.0 | 4.0 | 5.1 | 1.00 | 10.0 | 0.25 | 0.10 |
| Ex 3 | 5.0 | 12.0 | 1.00 | 4.0 | 4.0 | 5.4 | 1.00 | 8.5 | 0.25 | 0.10 |
| Ex 4 | 5.0 | 4.0 | 1.00 | 4.0 | 4.0 | 5.4 | 1.00 | 8.5 | 0.25 | 0.10 |
| Ex 5 | 4.9 | 8.0 | 1.00 | 4.2 | 4.0 | 5.4 | 1.00 | 8.5 | 0.25 | 0.10 |
| EX 6 | 4.9 | 8.0 | 1.00 | 4.2 | 4.0 | 5.4 | 1.00 | 8.5 | 0.16 | 0.10 |
| Ex 7 | 4.7 | 7.0 | 0.50 | 4.0 | 5.0 | 5.4 | 0.80 | 8.5 | 0.25 | 0.10 |
| Ex 8 | 4.5 | 5.0 | 0.50 | 5.0 | 4.0 | 5.4 | 1.00 | 8.5 | 0.25 | 0.10 |
| Ex 9 | 4.5 | 5.0 | 0.50 | 5.0 | 4.0 | 5.4 | 0.55 | 10.0 | 0.25 | 0.10 |
| Ex 10 | 4.3 | 5.0 | 0.50 | 4.0 | 4.0 | 5.4 | 1.00 | 8.5 | 0.25 | 0.10 |
| Ex 11 | 3.0 | 9.6 | 0.60 | 6.6 | 6.4 | 5.6 | 1.00 | 6.5 | 0.10 | 0.00 |
| Ex 12 | 4.8 | 10.0 | 0.60 | 3.5 | 6.0 | 5.7 | 0.85 | 8.0 | 0.10 | 0.00 |
| Ex 13 | 6.0 | 3.0 | 0.40 | 2.0 | 5.0 | 5.7 | 0.20 | 8.0 | 0.03 | 0.00 |
| Ex 14 | 5.3 | 12.2 | 1.10 | 4.4 | 5.7 | 6.0 | 0.00 | 7.5 | 0.15 | 0.00 |

Density

The room temperature density of each superalloy was estimated using a modified version of the Hull formula (F. C. Hull, Metal Progress, November 1969, pp 139-140). This empirical equation was proposed by Hull. The empirical equation is based on the law of mixtures and includes corrective terms derived from a linear regression analysis of experimental data (chemical compositions and measured densities) for 235 superalloys and stainless steels. This Hull formula has been modified, in particular to take account of elements such as rhenium and ruthenium. The modified Hull formula is as follows:

$$D=27.68\times[D_1+0.14037-0.00137\%\ Cr-0.00139\%\ Ni-0.00142\%\ Co-0.00140\%\ Fe-0.00186\%\ Mo-0.00125\%\ W-0.00134\%\ V-0.00119\%\ Nb-0.00134\%\ V-0.00119\%\ Nb-0.00113\%\ Ta+0.0004\%\ Ti+0.00388\%\ C+0.0000187\ (\%\ Mo)^2-0.0000506\ (\%\ Co)\times(\%\ Ti)-0.00096\%\ Re-0.001131\%\ Ru] \quad (1)$$

where $D_1=100/[(\%\ Cr/D_{Cr})+(\%\ Ni/D_{Ni})+\ldots+(\%\ X/D_X)]$ where $D_{Cr}$, $D_{Ni}$, . . . . $D_X$ are the densities of the elements Cr, Ni, . . . , X expressed in lb/in$^3$ (pounds per cubic inch) and D is the density of the superalloy expressed in g/cm$^3$.

where % Cr, % Ni, . . . % X are the contents, expressed in percentages by mass, of the superalloy elements Cr, Ni, . . . , X.

The calculated densities for the alloys of the invention and for the reference alloys are less than 9.00 g/cm$^3$ (see Table 2).

The comparison between the estimated and measured densities (see Table 2) is used to validate the modified Hull model (equation (1)). The estimated and measured densities are consistent.

Table 2 shows various parameters for superalloys Ex 1 to Ex 14.

TABLE 2

| | Estimated density (1) (g/cm$^3$) | Measured density (g/cm$^3$) | NFP | RGP | $\overline{M}d$ | $[SRZ(\%)]^{1/2}$ |
|---|---|---|---|---|---|---|
| Ex 1 | 8.89 | 8.82 | 0.84 | 0.393 | 0.98 | 5.3 |
| Ex 2 | 9.00 | 8.98 | 0.99 | 0.460 | 0.98 | 5.2 |
| Ex 3 | 8.86 | — | 0.89 | 0.393 | 0.99 | 1.0 |
| Ex 4 | 8.88 | — | 0.89 | 0.393 | 0.98 | 3.8 |
| Ex 5 | 8.86 | 8.86 | 0.90 | 0.393 | 0.98 | 3.4 |
| Ex 6 | — | — | 0.88 | 0.393 | — | 3.4 |
| Ex 7 | 8.91 | — | 0.82 | 0.386 | 0.98 | 3.6 |
| Ex 8 | 8.83 | 8.79 | 0.92 | 0.393 | 0.98 | −5.9 |
| Ex 9 | 8.91 | — | 1.10 | 0.388 | 0.98 | −6.5 |
| Ex 10 | — | — | 0.94 | 0.393 | — | 3.4 |
| Ex 11 | 8.71 | — | 0.65 | 0.358 | 0.99 | −24 |
| Ex 12 | 8.91 | — | 0.68 | 0.371 | 0.99 | 8.5 |
| Ex 13 | 8.99 | — | 0.67 | 0.299 | 0.96 | 28 |
| Ex 14 | 8.87 | — | 0.69 | 0.256 | 0.98 | 1.1 |

No-Freckles Parameter (NFP)

$$NFP=[\%\ Ta+1.5\%\ Hf+0.5\%\ Mo-0.5\%\ \%\ Ti)]/[\%\ W+1.2\%\ Re)] \quad (2)$$

where % Cr, % Ni, . . . % X are the contents, expressed in percentages by mass, of the superalloy elements Cr, Ni, . . . , X.

The NFP is used to quantify the sensitivity to the formation of freckles during directed solidification of the workpiece (document U.S. Pat. No. 5,888,451). To prevent the formation of freckles, the NFP must be greater than or equal to 0.7.

Figure 2:
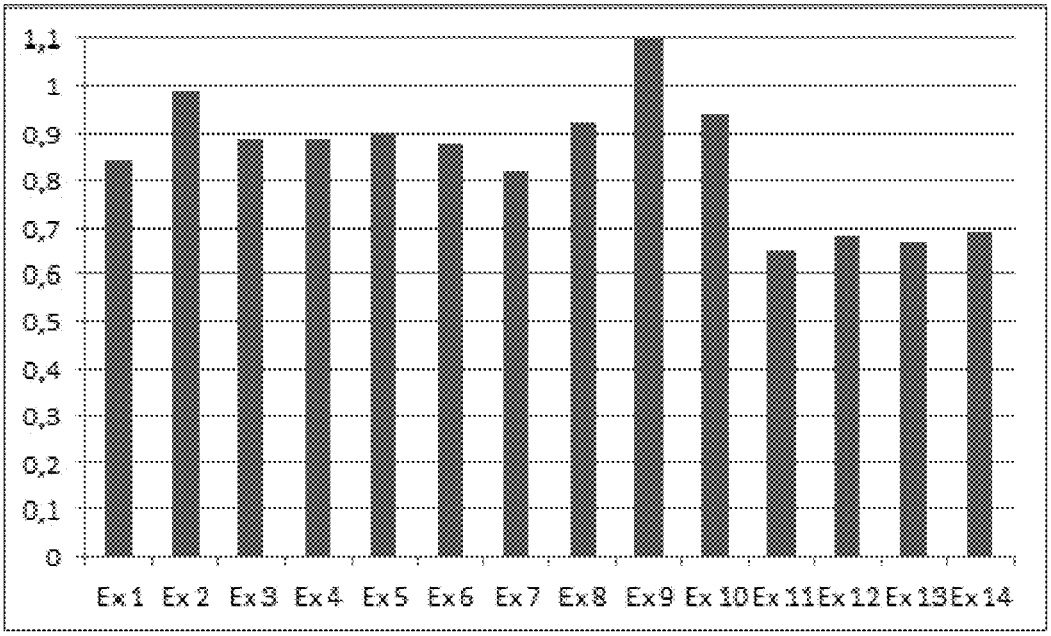
FIG. 2 is a graph representing the no-freckles parameter (NFP) for different superalloys.

As can be seen in Table 2 and FIG. 2, all Ex 1 to Ex 10 superalloys have an NFP greater than or equal to 0.7, whereas Ex 11 to Ex 14 commercial superalloys have an NFP less than 0.7.

Gamma Prime Resistance (GPR)

The intrinsic mechanical strength of the γ' phase increases with the content of elements substituting for aluminum in the $Ni_3Al$ compound, such as titanium, tantalum and part of tungsten. The γ' phase compound can therefore be written as $Ni_3(Al, Ti, Ta, W)$. The parameter GPR is used to estimate the level of hardening of the γ' phase:

$$GPR=[C_{Ti}+C_{Ta}+(C_W/2)]/C_{Al} \quad 3$$

where $C_{Ti}$, $C_{Ta}$, $C_W$ and $C_{Al}$ are the concentrations, expressed in atomic percent, of the elements Ti, Ta, W and Al, respectively, in the superalloy.

A higher GPR parameter is conducive to better mechanical strength of the superalloy. It can be seen from Table 2 that the GPR parameter calculated for superalloys Ex 1 to Ex 10 is higher than the GPR parameter calculated for commercial superalloys Ex 11 to Ex 14.

Sensitivity to the Formation of TCP ($\overline{M}d$)

The parameter $\overline{M}d$ is defined as follows:

$$\overline{M}d=\Sigma_{i=1}^{n}X_i(Md)_i \quad (4)$$

where $X_i$ is the fraction of element i in the superalloy expressed in atomic percent, $(Md)_i$ is the value of the parameter Md for element i.

Table 3 shows the Md values for the different elements of the superalloys.

TABLE 3

| Element | Md | Element | Md |
|---|---|---|---|
| Ti | 2.271 | Hf | 3.02 |
| Cr | 1.142 | Ta | 2.224 |
| Co | 0.777 | W | 1.655 |
| Ni | 0.717 | Re | 1.267 |
| Nb | 2.117 | Al | 1.9 |
| Mo | 1.55 | Si | 1.9 |
| Ru | 1.006 | | |

Sensitivity to TCP formation is determined by the parameter $\overline{M}d$, according to the New PHACOMP method which was developed by Morinaga et al. (Morinaga et al., New PHACOMP and its application to alloy design, Superalloys 1984, edited by M Gell et al., The Metallurgical Society of AIME, Warrendale, Pa., USA (1984) pp. 523-532). According to this model, the sensitivity of superalloys to the formation of TCP increases with the value of the parameter $\overline{M}d$.

As can be seen in Table 2, the superalloys Ex 1 to Ex 14 have values of the parameter $\overline{M}d$ approximately equal. These superalloys therefore exhibit similar sensitivities to the formation of TCP, sensitivities which are relatively low.

Sensitivity to SRZ Formation

To estimate the sensitivity of rhenium-containing nickel-based superalloys to the formation of SRZ, Walston (U.S. Pat. No. 5,270,123) developed the following equation:

$$[SRZ\ (\%)]^{1/2}=13.88(\%\ Re)+4.10(\%\ W)-7.07(\%\ Cr)-2.94(\%\ Mo)-0.33(\%\ Co)+12.13 \quad (5)$$

where SRZ (%) is the linear percentage of SRZ in the superalloy under the coating and where the concentrations of the alloying elements are in atomic percent.

This equation (5) was obtained by multiple linear regression analysis from observations made after aging for 400 hours at 1093° C. (degrees centigrade) of samples of various alloys of compositions close to the Ex 12 composition under a NiPtAl coating.

The higher the value of parameter $[SRZ (\%)]^{1/2}$, the more sensitive the superalloy is to SRZ formation. Thus, as can be seen in Table 2, for superalloys Ex 1 to Ex 10, the values of the parameter $[SRZ (\%)]^{1/2}$ are either negative or weakly positive and these superalloys therefore have a low sensitivity to SRZ formation under a NitPtAl coating, as does the commercial superalloy Ex 14, which is known for its low sensitivity to SRZ formation. By way of example, the commercial superalloy EX 13, which is known to be very sensitive to the formation of SRZ under a NiPtAl coating, has a relatively high value of the parameter $[SRZ (\%)]^{1/2}$.

Phase γ' Solvus Temperature

ThermoCalc software (Ni25 database) based on the CALPHAD method was used to calculate the solvus temperature of the γ' phase at equilibrium.

As can be seen from Table 4, Ex 1 to Ex 10 superalloys have a higher γ' solvus temperature than the γ' solvus temperature of Ex 11, Ex 12 and Ex 14 superalloys.

Phase γ' Volume Fraction

The ThermoCalc software (Ni25 database) based on the CALPHAD method was used to calculate the volume fraction (volume percent) of phase γ' at equilibrium in superalloys Ex 1 to Ex 14 at 950° C., 1050° C. and 1200° C.

Figure 3:
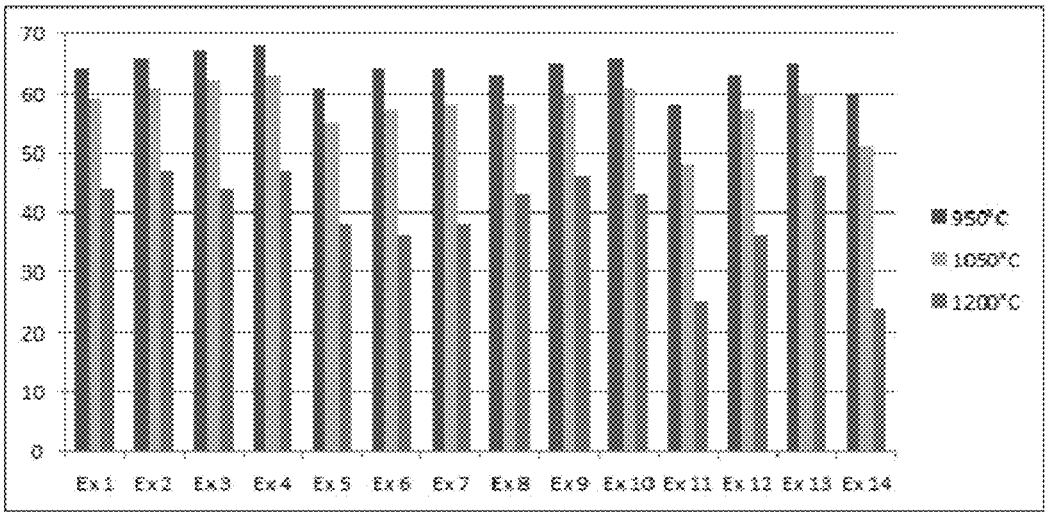
FIG. 3 is a graph representing the γ' phase volume fraction at different temperatures and for different superalloys.

As can be seen in Table 4 and FIG. 3, Ex 1 to Ex 10 superalloys contain higher or comparable phase γ' volume fractions than the phase γ' volume fractions of Ex 11 to Ex 14 commercial superalloys.

Thus, the combination of high γ' solvus temperature and high phase γ' volume fractions for superalloys Ex 1 to Ex 10 is favorable for good creep resistance at high and very high temperatures, for example at 1200° C. This strength should therefore be higher than the creep strength of commercial superalloys Ex 11 to Ex 14 and close to that of commercial superalloy Ex 13.

TABLE 4

| | $T_{solvus}$ Y' | Phase Y' volume fraction (% vol) | | |
|---|---|---|---|---|
| | (° C.) | 950° C. | 1050° C. | 1200° C. |
| Ex 1 | 1347 | 64 | 59 | 44 |
| Ex 2 | 1353 | 66 | 61 | 47 |
| Ex 3 | 1280 | 67 | 62 | 44 |
| Ex 4 | 1346 | 68 | 63 | 47 |
| Ex 5 | 1328 | 61 | 55 | 38 |
| Ex 6 | 1314 | 64 | 57 | 36 |
| Ex 7 | 1328 | 64 | 58 | 38 |
| Ex 8 | 1342 | 63 | 58 | 43 |
| Ex 9 | 1347 | 65 | 60 | 46 |
| Ex 10 | 1336 | 66 | 61 | 43 |
| Ex 11 | 1290 | 58 | 48 | 25 |
| Ex 12 | 1320 | 63 | 57 | 36 |
| Ex 13 | 1374 | 65 | 60 | 46 |
| Ex 14 | 1283 | 60 | 51 | 24 |

Volume Fraction of TCP Type σ

The ThermoCalc software (Ni25 database) based on the CALPHAD method was used to calculate the volume fraction (volume percent) of equilibrium phase σ in superalloys Ex 1 to Ex 14 at 950° C. and 1050° C. (see Table 5).

The calculated volume fractions of the phase σ are relatively small, reflecting a low sensitivity to TCP precipitation. These results therefore corroborate the results obtained with the New PHACOMP method (parameter $\overline{M}d$).

Mass Concentration of Chromium Dissolved in the γ Matrix

The ThermoCalc software (Ni25 database) based on the CALPHAD method was used to calculate the chromium content (in percent by mass) in the γ phase at equilibrium in superalloys Ex 1 to Ex 14 at 950° C., 1050° C. and 1200° C.

As can be seen in Table 5, the chromium concentrations in the γ phase are higher for superalloys Ex 1 to Ex 10 compared with the chromium concentrations in the γ phase for commercial superalloys Ex 12 to Ex 14, which is conducive to better corrosion and hot oxidation resistance.

TABLE 5

| | Volume fraction of TCP type σ (in % vol) | | Chromium content in the y phase (in % by mass) | | |
|---|---|---|---|---|---|
| | 950° C. | 1050° C. | 950° C. | 1050° C. | 1200° C. |
| Ex 1 | 1.1 | 0.5 | 8.63 | 7.65 | 5.79 |
| Ex 2 | 1.4 | 0.7 | 9.02 | 8.03 | 6.25 |
| Ex 3 | 1.2 | 0.6 | 8.63 | 7.64 | 5.79 |
| Ex 4 | 1.4 | 0.7 | 8.77 | 7.82 | 5.96 |
| Ex 5 | 1.2 | 0.1 | 8.86 | 7.81 | 6.05 |
| Ex 6 | 0.9 | 0.1 | 11.00 | 9.50 | 6.80 |
| Ex 7 | 0.8 | 0.6 | 8.35 | 7.30 | 5.45 |
| Ex 8 | 0.9 | 0.2 | 10.83 | 9.63 | 7.57 |
| Ex 9 | 1.2 | 0.5 | 11.25 | 9.95 | 7.71 |
| Ex 10 | 0.4 | 0.0 | 10.40 | 9.20 | 6.80 |
| Ex 11 | 0.7 | — | 12.80 | 10.90 | 7.84 |
| Ex 12 | 1.2 | 0.5 | 7.40 | 6.43 | 4.82 |
| Ex 13 | 0.9 | 0.4 | 3.62 | 3.36 | 2.77 |
| Ex 14 | 1.0 | 0.3 | 8.37 | 7.10 | 5.25 |

Very High Temperature Creep Property

Creep tests were carried out on the superalloys Ex 2, Ex 5, Ex 6, Ex 11, Ex 13 and Ex 14. Creep tests were performed at 1200° C. and 80 MPa according to the NF EN ISO 204 standard of August 2009 (Guide U125_J).

The results of creep tests in which the superalloys were loaded (80 MPa) at 1200° C. are shown in Table 6. The results represent the time in hours (h) at specimen failure.

TABLE 6

| | Time to break (hour) |
|---|---|
| Ex 2 | 41 |
| Ex 5 | 65 |
| Ex 6 | 50 |
| Ex 10 | 54 |
| Ex 11 | 9 |
| Ex 13 | 59 |
| Ex 14 | 13 |

Superalloys Ex 2, Ex 5, Ex 6 and Ex 10 exhibit better creep behavior than Ex 11 and Ex 14 alloys. Superalloy Ex 13 also has good creep properties.

Cyclic Oxidation Property at 1150° C.

The superalloys are thermally cycled as described in INS-TTH-001 and INS-TTH-002: Oxidative Cycling Test Method (Mass Loss Test and Thermal Barrier).

A specimen of the superalloy under test (pin having a diameter of 20 mm and a height of 1 mm) is subjected to thermal cycling, each cycle of which comprises a rise to 1150° C. in less than 15 min (minutes), a 60 min stop at 1150° C. and turbine-cooling of the specimen for 15 min.

The thermal cycle is repeated until a loss in mass of the test piece equal to 20 mg/cm$^2$ (milligrams per square centimeter) is observed.

The service life of the superalloys tested is shown in Table 7.

TABLE 7

| | Service life (hours) |
|---|---|
| Ex 2 | 1310 |
| Ex 5 | >1700 |
| Ex 10 | >1700 |
| Ex 11 | ~230 |
| Ex 12 | ~480 |
| Ex 13 | ~100 |

It can be seen that Ex 2, Ex 5 and Ex 10 superalloys have a much longer service life than Ex 11, Ex 12 and Ex 13 superalloys. It should be noted that the oxidation properties of the Ex 13 superalloy are much poorer than those of the Ex 2, Ex 5 and Ex 10 superalloys.

Microstructural Stability

After aging for 300 hours at 1050° C., no TCP phase is observed for Ex 6 superalloy by scanning electron microscopy image analysis.

Sensitivity to Foundry Defect Formation

After forming by the lost-wax process and directional solidification in the Bidgman furnace, no defects resulting from the casting process, particularly of the "freckles" type, were observed in the Ex 2, Ex 5, Ex 6 and Ex 10 superalloys. The "freckles" type defects are observed after immersion of the specimen in a solution based on $HNO_3/H_2SO_4$.

Although the present disclosure has been described with reference to a specific example of a specific embodiment, it is obvious that various modifications and changes can be made to these examples without going beyond the general scope of the invention as defined by the claims. In addition, individual features of the different embodiments referred to may be combined in additional embodiments. Therefore, the description and drawings should be considered in an illustrative rather than restrictive sense.

The invention claimed is:

1. A nickel-based superalloy consisting of, in percentages by mass, 4.0 to 5.5% rhenium, 3.5 to 12.5% cobalt, 0.30 to 1.50% molybdenum, 3.5 to 5.5% chromium, 3.5 to 5.5% tungsten, 4.5 to 6.0% aluminum, 0.35 to 1.50% titanium, 8.0 to 10.5% tantalum, 0.15 to 0.30% hafnium, 0.05 to 0.15% silicon, the balance being nickel and unavoidable impurities, wherein the nickel-based superalloy has a no-freckles parameter (NFP) greater than or equal to 0.7, wherein the NFP is quantified by [the mass percentage of tantalum+(1.5*the mass percentage of hafnium+(0.5*the mass percentage of molybdenum)−(0.5*the mass percentage of titanium)]/[the mass percentage of tungsten+(1.2*the mass percentage of rhenium)].

2. The superalloy according to claim 1, wherein the percentages by mass are 4.0 to 5.5% rhenium, 3.5 to 8.5% cobalt, 0.30 to 1.50% molybdenum, 3.5 to 5.5% chromium, 3.5 to 4.5% tungsten, 4.5 to 6.0% aluminum, 0.50 to 1.50% titanium, 8.0 to 10.5% tantalum, 0.15 to 0.30% hafnium, 0.05 to 0.15% silicon, the balance being nickel and unavoidable impurities.

3. The superalloy according to claim 1, wherein the percentages by mass are 4.0 to 5.5% rhenium, 3.5 to 12.5% cobalt, 0.30 to 1.50% molybdenum, 3.5 to 5.5% chromium, 3.5 to 5.5% tungsten, 5.0 to 6.0% aluminum, 0.35 to 1.50% titanium, 8.0 to 10.5% tantalum, 0.15 to 0.30% hafnium, 0.05 to 0.15% silicon, the balance being nickel and unavoidable impurities.

4. The superalloy according to claim 1, wherein the percentages by mass are 4.5 to 5.5% rhenium, 4.0 to 6.0% cobalt, 0.30 to 1.00% molybdenum, 3.5 to 4.5% chromium, 3.5 to 4.5% tungsten, 4.5 to 6.0% aluminum, 0.50 to 1.50% titanium, 8.0 to 10.5% tantalum, 0.15 to 0.30% hafnium, 0.05 to 0.15% silicon, the balance being nickel and unavoidable impurities.

5. The superalloy according to claim 1, wherein the percentages by mass are 4.5 to 5.5% rhenium, 3.5 to 12.5% cobalt, 0.50 to 1.50% molybdenum, 3.5 to 4.5% chromium, 3.5 to 4.5% tungsten, 5.0 to 6.0% aluminum, 0.50 to 1.50% titanium, 8.0 to 9.0% tantalum, 0.15 to 0.30% hafnium, 0.05 to 0.15% silicon, the balance being nickel and unavoidable impurities.

6. The superalloy according to claim 1, wherein the percentages by mass are 4.5 to 5.5% rhenium, 7.0 to 9.0% cobalt, 0.50 to 1.50% molybdenum, 3.5 to 4.5% chromium, 3.5 to 4.5% tungsten, 5.0 to 6.0% aluminum, 0.50 to 1.50% titanium, 8.0 to 9.0% tantalum, 0.15 to 0.30% hafnium, 0.05 to 0.15% silicon, the balance being nickel and unavoidable impurities.

7. The superalloy according to claim 1, wherein the percentages by mass are 4.2 to 5.3% rhenium, 6.0 to 8.0% cobalt, 0.30 to 1.00% molybdenum, 3.5 to 4.5% chromium, 4.5 to 5.5% tungsten, 5.0 to 6.0% aluminum, 0.35 to 1.30% titanium, 8.0 to 9.0% tantalum, 0.15 to 0.30% hafnium, 0.05 to 0.15% silicon, the balance being nickel and unavoidable impurities.

8. The superalloy according to claim 1, wherein the percentages by mass are 4.0 to 5.0% rhenium, 4.0 to 6.0% cobalt, 0.30 to 1.00% molybdenum, 4.5 to 5.5% chromium, 3.5 to 4.5% tungsten, 5.0 to 6.0% aluminum, 0.35 to 1.30% titanium, 8.0 to 10.5% tantalum, 0.15 to 0.30% hafnium, 0.05 to 0.15% silicon, the balance being nickel and unavoidable impurities.

9. The superalloy according to claim 1, wherein the percentages by mass are 5.2% rhenium, 5.0% cobalt, 0.50% molybdenum, 4.0% chromium, 4.0% tungsten, 5.4% aluminum, 1.00% titanium, 8.5% tantalum, 0.25% hafnium, 0.10% silicon, the balance being nickel and unavoidable impurities.

10. The superalloy according to claim 1, wherein the percentages by mass are 5.2% rhenium, 5.0% cobalt, 0.50% molybdenum, 4.0% chromium, 4.0% tungsten, 5.4% aluminum, 1.00% titanium, 8.5% tantalum, 0.17% hafnium, 0.10% silicon, the balance being nickel and unavoidable impurities.

11. The superalloy according to claim 1, wherein the percentages by mass are 5.2% rhenium, 5.0% cobalt, 0.50% molybdenum, 4.0% chromium, 4.0% tungsten, 5.1% aluminum, 1.00% titanium, 10.0% tantalum, 0.25% hafnium, 0.10% silicon, the balance being nickel and unavoidable impurities.

12. The superalloy according to claim 1, wherein the percentages by mass are 5.0% rhenium, 12.0% cobalt, 1.00% molybdenum, 4.0% chromium, 4.0% tungsten, 5.4% aluminum, 1.00% titanium, 8.5% tantalum, 0.25% hafnium, 0.10% silicon, the balance being nickel and unavoidable impurities.

13. The superalloy according to claim 1, wherein the percentages by mass are 5.0% rhenium, 4.0% cobalt, 1.00% molybdenum, 4.0% chromium, 4.0% tungsten, 5.4% aluminum, 1.00% titanium, 8.5% tantalum, 0.25% hafnium, 0.10% silicon, the balance being nickel and unavoidable impurities.

14. The superalloy according to claim 1, wherein the percentages by mass are 4.9% rhenium, 8.0% cobalt, 1.00% molybdenum, 4.2% chromium, 4.0% tungsten, 5.4% aluminum, 1.00% titanium, 8.5% tantalum, 0.25% hafnium, 0.10% silicon, the balance being nickel and unavoidable impurities.

15. The superalloy according to claim 1, wherein the percentages by mass are 4.9% rhenium, 8.0% cobalt, 1.00% molybdenum, 4.2% chromium, 4.0% tungsten, 5.4% aluminum, 1.00% titanium, 8.5% tantalum, 0.17% hafnium, 0.10% silicon, the balance being nickel and unavoidable impurities.

16. The superalloy according to claim 1, wherein the percentages by mass are 4.9% rhenium, 8.0% cobalt, 1.00% molybdenum, 4.2% chromium, 4.0% tungsten, 5.4% aluminum, 1.00% titanium, 8.5% tantalum, 0.16% hafnium, 0.10% silicon, the balance being nickel and unavoidable impurities.

17. The superalloy according to claim 1, wherein the percentages by mass are 4.7% rhenium, 7.0% cobalt, 0.50% molybdenum, 4.0% chromium, 5.0% tungsten, 5.4% aluminum, 0.80% titanium, 8.5% tantalum, 0.25% hafnium, 0.10% silicon, the balance being nickel and unavoidable impurities.

18. The superalloy according to claim 1, wherein the percentages by mass are 4.5% rhenium, 5.0% cobalt, 0.50% molybdenum, 5.0% chromium, 4.0% tungsten, 5.4% aluminum, 1.00% titanium, 8.5% tantalum, 0.25% hafnium, 0.10% silicon, the balance being nickel and unavoidable impurities.

19. The superalloy according to claim 1, wherein the percentages by mass are 4.5% rhenium, 5.0% cobalt, 0.50% molybdenum, 5.0% chromium, 4.0% tungsten, 5.4% aluminum, 0.55% titanium, 10.0% tantalum, 0.25% hafnium, 0.10% silicon, the balance being nickel and unavoidable impurities.

20. The superalloy according to claim 1, wherein the percentages by mass are 4.3% rhenium, 5.0% cobalt, 0.50% molybdenum, 4.0% chromium, 4.0% tungsten, 5.4% aluminum, 1.00% titanium, 8.5% tantalum, 0.25% hafnium, 0.10% silicon, the balance being nickel and unavoidable impurities.

21. A single-crystal blade for a turbomachine comprising a superalloy according to claim 1.

22. The blade according to claim 21, comprising a protective coating comprising a metallic bond coat deposited on the superalloy and a ceramic thermal barrier deposited on the metallic bond coat.

23. The blade according to claim 21, having a structure oriented in a <001> crystallographic direction.

24. A turbomachine comprising a blade according to claim 21.

* * * * *